US007421936B2

(12) United States Patent
Barger et al.

(10) Patent No.: US 7,421,936 B2
(45) Date of Patent: Sep. 9, 2008

(54) SYSTEMS AND METHODS FOR EXPLOSIVE BLAST WAVE MITIGATION

(75) Inventors: James E. Barger, Winchester, MA (US); Daniel L. Hamel, Waterford, CT (US)

(73) Assignee: BBN Technologies Corp., Cambridge, MA (US)

( * ) Notice: Subject to any disclaimer, the term of this patent is extended or adjusted under 35 U.S.C. 154(b) by 473 days.

(21) Appl. No.: 11/112,941

(22) Filed: Apr. 22, 2005

(65) Prior Publication Data

US 2008/0190276 A1 Aug. 14, 2008

(51) Int. Cl.
*F41H 11/00* (2006.01)

(52) U.S. Cl. ..... 89/36.02; 89/36.05; 89/36.04; 89/36.08; 89/36.11; 89/36.12; 86/50

(58) Field of Classification Search ..... 89/36.17, 89/36.02, 36.04, 36.07, 36.08, 36.09, 36.11, 89/36.12, 36.05; 86/50; 109/1 S
See application file for complete search history.

(56) References Cited

U.S. PATENT DOCUMENTS

| | | | | | |
|---|---|---|---|---|---|
| 3,660,951 | A * | 5/1972 | Cadwell | 52/2.18 |
| 4,543,872 | A * | 10/1985 | Graham et al. | 86/50 |
| 5,992,104 | A * | 11/1999 | Hudak | 52/167.1 |
| 6,029,558 | A * | 2/2000 | Stevens et al. | 89/36.17 |
| 6,266,926 | B1 * | 7/2001 | Figge et al. | 52/1 |
| 6,298,607 | B1 * | 10/2001 | Mostaghel et al. | 52/1 |
| 6,412,391 | B1 * | 7/2002 | Stevens et al. | 89/36.17 |
| 7,017,705 | B2 * | 3/2006 | Ponomarev et al. | 181/210 |
| 7,213,494 | B2 * | 5/2007 | James | 86/50 |
| 2007/0007384 | A1 * | 1/2007 | Sliwa, Jr. | 244/30 |
| 2007/0094944 | A1 * | 5/2007 | James | 52/79.1 |

FOREIGN PATENT DOCUMENTS

| | | | |
|---|---|---|---|
| EP | 276918 | A1 * | 8/1988 |
| GB | 2417681 | A * | 3/2006 |
| WO | WO 2005090897 | A * | 9/2005 |
| WO | WO 2005090898 | A * | 9/2005 |

* cited by examiner

*Primary Examiner*—James S Bergin
(74) *Attorney, Agent, or Firm*—Ropes & Gray LLP

(57) ABSTRACT

The invention in various embodiments is directed to systems and methods for mitigating damage from a shock wave using a gas having a specific impedance less than air.

10 Claims, 18 Drawing Sheets

| STRUCTURAL DAMAGE | |
|---|---|
| **OVERPRESSURE (psi)** | **DAMAGE** |
| .15 - .22 | GLASS BREAKAGE |
| .5 - 1.1 | MINOR DAMAGE TO SOME BUILDINGS |
| 1.1 - 1.8 | PANELS OF SHEET METAL BUCKLED |
| 1.8 - 2.9 | FAILURE OF CONCRETE BLOCK WALLS |
| 4 - 7 | COLLAPSE OF WOOD FRAMED BUILDINGS, SERIOUS DAMAGE TO STEEL FRAMED BUILDINGS |
| 6 - 9 | SEVERE DAMAGE TO REINFORCED CONCRETE STRUCTURES |
| 10 - 12 | PROBABLE TOTAL DESTRUCTION OF MOST BUILDINGS |
| 0.8 | HURRICANE (BUT WITH LARGE IMPULSE) |

FIG. 1A

| INJURIES AS A RESULT OF OVERPRESSURE | | |
|---|---|---|
| **OVERPRESSURE (psi)** | **INJURY** | **SURVIVORS** |
| GREATER THAN 80 | BODY DISRUPTION | NONE |
| 50 TO 80 | LUNG DAMAGE, MISSILES | FEW |
| LESS THAN 50 | HEAD INJURIES, LUNG DAMAGE | MANY |

FIG. 1B $$P_{inside} = Z_{inside}\, V_{wall} = Z_{inside}\, P_{incident}\, Y_{vehicle}$$

$$Z_{air} = 440\ Pa \bullet s/m$$

$$Z_{He} = 173\ Pa \bullet s/m$$

10

SYSTEMS AND METHODS FOR EXPLOSIVE BLAST WAVE MITIGATION

FEDERALLY SPONSORED RESEARCH

The inventions described herein were made with government support under DARPA Contract Number HR0011-04-C-0086. Accordingly, the government may have certain rights in the inventions.

FIELD OF THE INVENTION

The invention generally relates to mitigating shock waves. More particularly, in various embodiments, the invention is directed to systems, methods and devices employing an acoustic lens for mitigating the shock waves from an explosion.

BACKGROUND

Shock waves are traveling pressure fluctuations that cause local compression of the material through which they travel. When traveling through a gas, such as air, shock waves produce increases in pressure, referred to as "overpressure", along with increases in temperature. They also accelerate gas molecules and entrained particulates in the direction of shock wave travel. Shock waves produced by explosions also release substantial amounts of thermal and radiant energy.

Shock waves can cause significant damage to both humans and mechanical structures. The overpressure caused by a shock wave is one source of such damage. As indicated in FIG. 1A, panels of sheet metal buckle due to an overpressure as low as about 1.1-1.8 psi. Concrete walls fail at overpressures between about 1.8-2.9 psi, and most buildings are completely destroyed by over pressures of about 10-12 psi. As indicated in FIG. 1B, an overpressure of greater than about 50 psi creates sufficient body disruption to severely injure, and in many instances, kill a human being.

Traditionally, various chemical and mechanical approaches have been employed to attenuate, deflect and/or diffract shock waves to mitigate the damage they cause. Prior art approaches include, for example, solid barriers, mechanical venting, chemical agents, aqueous foams, solid foams, solid beads, and combinations thereof. All of the prior art approaches for shock wave mitigation suffer from significant drawbacks, such as being toxic to humans, too heavy, too bulky, not easily transportable, and not usable in a wide variety of applications.

For example, one prior art approach employs solid barriers for deflecting incident and/or attenuating shock waves, and for providing protection from fragments and thermal effects. Such solid barriers suffer from several shortcomings. Where protection of large areas from powerful shock effects is necessary, structures must be massive and are thus inherently immobile, expensive and time consuming to erect.

Another prior art approach employs blast mats. A disadvantage of blast mats is that they are heavy and bulky. When not being used, they require large amounts of storage, and due to their weight and bulk are not easily moved from storage to a location where they are needed. Also, blast mats provide little acoustic damping.

Mechanical venting is widely employed for mitigating blast overpressure in containment structures (e.g., grain silos, explosive material handling rooms, and the like). The vents normally constitute part of a containment wall. Besides reliability and response time problems, venting requires facilities to be designed such that overpressure release will not endanger personnel or nearby structures. Venting does not provide protection from a blast originating in an open, uncontained environment. Venting also cannot be employed where hazardous materials may be released, and does not provide significant shock wave attenuation.

Chemical agents suppress shock waves by extinguishing or interrupting the combustion process that generates them. Such agents include, for example, carbon dioxide and halogenated carbon compounds ("halons"), which may be gaseous or liquid at the time of application, and dry powders, most of which are salts of ammonium or alkali metals, such as sodium and potassium. Chemical combustion-extinguishing agents are generally effective in confined spaces, with powders also being effective in unconfined environments. However, chemical agents currently available for fire and explosion suppression typically have toxic effects upon humans at the concentrations required to be effective. Also, aside from removing the source of the shock wave, they do not provide any significant attenuation for the shock wave caused by the initial explosion.

Aqueous foams have been proven to be capable of providing significant shock wave attenuation. Aqueous foams rely, in part, on scattering and dispersing the pressure waves at the bubble/cell walls. Also, the displacement of the bubbles in the aqueous foam absorbs substantial energy. Additionally, shock waves propagating through aqueous foams create turbulent flow fields, which also dissipates substantial amounts of energy, particularly when reflected waves travel through the turbulent medium. Typically, aqueous foam for pressure wave attenuation is deployed either in an unconfined deluge or as a filler material in solid confining walls. High-capacity foam deluge systems have been used for perimeter security and for flooding buildings to provide explosion protection from bombs. Aqueous foam-filled containers have also been used for safe removal and disposal of explosives. Variants of the foam-filled container concept have been developed as noise-attenuation devices ("silencers") for the muzzles of firearms and large naval guns. One drawback of aqueous foam is that it requires a foam generation system and/or a large bulky supply of foam to be stored wherever it is to be deployed. Solid foams have also been employed for shock wave attenuation. However, solid foams have proven not to be as effective as aqueous foams at attenuating shock waves. Turbulent flow fields are not generated within solid foams, and bubble displacements cannot occur.

According to another prior art approach, loosely packed beads are employed to attenuate shock waves. The beads, unlike the solid foam bubbles, are capable of relative displacement in the nature of a fluid. In such a form, the beads act similarly to the bubbles in an aqueous foam. Specifically, transmitting shock waves are scattered and dispersed at the bead surfaces, and the displacement of the bead mass absorbs substantial energy. In some implementations, the beads are made to resist displacement to a limited extent (below the degree where the bead mass would act more as a rigid panel than a fluid) to further attenuate the shock wave. However, the solid bead approach suffers from the drawback that it is typically employed with a solid rigid frame for containing the beads, foam or a combination thereof.

Because prior art approaches to shock wave attenuation suffer from significant deficiencies, including being too heavy, not being easily transportable, taking up too much storage, they are not practical for many applications where explosion hazards are present, such as, battle field conditions where structures need to be easily erected, dismantled and transported. The deficiencies also render them impractical for personal body protection for soldiers, and for motor vehicle protection.

SUMMARY OF THE INVENTION

The invention addresses the deficiencies of the prior art by, in various embodiments, providing improved systems and methods for mitigating damage from by a shock wave caused by an explosion. More particularly, in one aspect, the invention provides systems and methods for mitigating such damage in a substantially contained environment. Such environments, include, without limitation, interiors of land, water and air vehicles, and interior portions of buildings, both large and small and both permanent and portable in nature.

In one embodiment, the invention detects an explosion external to the contained environment using, for example, ultraviolet and/or infrared detectors. In response to detecting such an explosion, the invention releases a gas having specific acoustic impedance less than air into the substantially contained environment. Preferably, the volume of the gas is sufficient to fill substantially the environment. Since the pressure inside the environment directly relates to the specific acoustic impedance of the gas that fills it, the newly introduced gas reduces a peak overpressure that can occur in as a result of the shock wave. More particularly, the peak overpressure in the environment is reduced by a factor of one minus the ratio of the specific acoustic impedance of the introduced gas to specific acoustic impedance of air. Subsequent to the shock wave passing, the invention vents the introduced gas and provides clean air back into the environment.

Any gas that does not cause permanent damage to humans as a result of short time exposure and that has specific acoustic impedance less than air may be employed by the invention, and provides a reduction in overpressure as compared to air. However, the lower the specific acoustic impedance of the gas, the greater the reduction in overpressure. Thus, according to various implementations, the invention employs a gas having a specific acoustic impedance of less than about 350 Pa·s/m, 300 Pa·s/m, 250 Pass/m, 200 Pa·s/m, or 150 Pa·s/m. According to some implementations, the invention introduces helium or argon into the contained environment to reduce the overpressure. Also, any gas heated sufficiently will have low specific acoustic impedance, for example, air heated to about 1000 K has the same low acoustic impedance as helium at room temperature.

According to another aspect, the invention mitigates damage to a target, in general, from a shock wave caused by an explosion. The target may be, for example, a land, air or water vehicle, or a building, both large and small and both permanent and portable in nature. According to one embodiment, the invention interposes a convex gas lens between an explosion and the target to deflect, diffract, disburse or otherwise direct the shock wave away from the target.

In some embodiments, the invention provides the gas lens in response to detecting the explosion. By way of example, the system of the invention may include a low impedance lens gas source, and cause one or more inflatable bladders to inflate with the lens gas in response to detecting the explosion. The one or more inflated bladders provide the convex lens for directing the shock wave away from the target. According to one configuration, the bladders are sized and shaped to provide a lens having a focal length about equal to the distance between the lens and the target to be protected.

In various implementations, the inflatable bladders are located on external surfaces of the target. For example, they may be mounted on an external structure of a building or a vehicle, or on the external surfaces of a soldier's clothing. In some embodiments, the one or more inflatable bladders are formed integrally into a soldier's uniform and/or other body armor. In other embodiments, the one or more inflatable bladders are formed into a fabric used for covering portions of targets, or for acting as the walls and/or roofs for portable buildings. The one or more inflatable bladders may also be fabricated into conventional blast mats to provide improved shock wave damping, or alternatively, may be formed into a light weight replacement for conventional blast mats.

According to other embodiments, the lens bladders are maintained in an inflated state. In these embodiments, explosion detection is not necessarily needed, nor is any valve mechanism for automatically releasing the lens gas in response to such detection. An advantage of this configuration is that time is not lost releasing the gas. Additionally, the lens gas is warmer if it has not just been quickly released into the bladder, and the warmer gas provides improved shock wave damping characteristics.

Other features and advantages of the invention will become apparent from the below description of the illustrative embodiments.

BRIEF DESCRIPTION OF THE DRAWINGS

The illustrative embodiments may be better understood with reference to the appended drawings in which like reference designations refer to like parts and in which the various views may not be drawn to scale.

FIGS. 1A and 1B show the type of damage that overpressure from shock waves can do to both human beings and mechanical structures;

DESCRIPTION OF ILLUSTRATIVE EMBODIMENTS

As described above in summary, the invention generally relates to mitigating damage done by shock waves caused by an explosion. As such, the invention has particular application to transfer and storage of explosive substances; battle field protection, including personal, vehicle and building; and protection against terrorist attacks. According to various illustrative embodiments, the invention is directed to systems and methods that substantially fill a contained or substantially contained environment with a gas having specific acoustic impedance (Z) less than the specific acoustic impedance of air to reduce peak overpressure within the environment. In other illustrative embodiments, the invention is directed to systems and methods that interpose a low impedance gas lens between an explosion and a target to be protected. In some implementations, the environment gas filling features and the interposed gas lens features are combined into a comprehensive system for mitigating damage and injury caused by an explosive blast wave originating outside of the environment.

Figure 2:
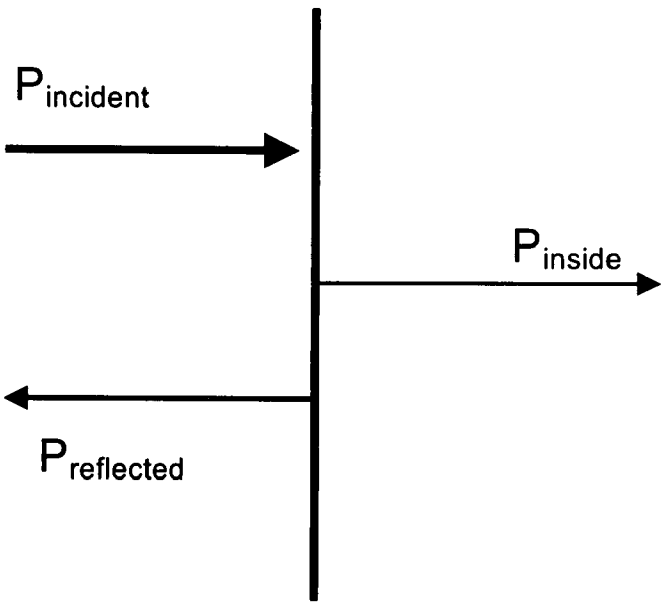
FIG. 2 is a conceptual drawing illustrating the shock wave attenuation achieved by filling a confined space with a gas in response to a blast detection according to an illustrative embodiment of the invention.

FIG. 2 is a conceptual drawing 10 illustrating shock wave attenuation achieved by filling or substantially filling a confined or substantially confined space with a low impedance gas in response to a blast detection according to an illustrative embodiment of the invention. Such environments, include, without limitation, interiors of land, water and air vehicles, and interior portions of buildings, both large and small and both permanent and portable in nature.

According to the illustrative embodiment, the invention detects an explosion external to the confined space using, for example, ultraviolet and/or infrared detectors. An advantage of such detectors is that they provide relatively early detection of the explosion, which in turn provides enough time for the blast wave mitigation mechanism of the invention to deploy prior to arrival of the blast wave at the target 14. In response to detecting such an explosion, the invention releases the low impedance gas into the space. Preferably, the volume of the gas is sufficient to fill substantially the space. Any gas that does not cause permanent damage to humans as a result of short time (e.g., less than about 5 minutes) exposure and that has specific acoustic impedance less than that of air may be employed by the invention. However, the lower the specific acoustic impedance, the greater the reduction in overpressure. Thus, according to various implementations, the invention employs a gas having a specific acoustic impedance of less than about 350 Pa·s/m, 300 Pa·s/m, 250 Pa·s/m, 200 Pa·s/m, or 150 Pa·s/m. According to some implementations, the invention introduces helium or argon into the contained environment to reduce the overpressure.

In the example of FIG. 2, helium is employed as the gas. Helium is well suited for this application since short term exposure does not cause harm to humans and it has a specific acoustic impedance less than half that of air.

As shown in FIG. 2, the pressure inside the space/environment can be estimated as:

$$P_{inside}=Z_{inside}V_{wall}=Z_{inside}P_{incient}Y_{vehicle}$$

where $P_{inside}$ is the pressure inside the space, $Z_{inside}$ is the specific acoustic impedance of the gas inside the space, $V_{wall}$ is the velocity of the wall exposed to the shock wave, and $Y_{vehicle}$ is the specific mechanical admittance of the vehicle wall.

Since the pressure inside the space depends on the specific acoustic impedance of the gas that fills it, the newly introduced gas reduces a peak overpressure that can occur in as a result of the shock wave. With $Z_{air}$=440 Pa·s/m and $Z_{He}$=173 Pa·s/m, the ratio of $Z_{He}/Z_{air}$ is about 0.39. Thus, replacing the air in the space with helium reduces the peak overpressure by about 61%.

According to the illustrative embodiment, the helium used to fill the space may be stored in bottles at about 5 kpsi. Under this condition, 10 $m^3$ of helium has a stored volume of about 300 liters. Subsequent to the shock wave passing, the system of the invention vents the introduced gas and provides clean air back into the space.

Figure 3:
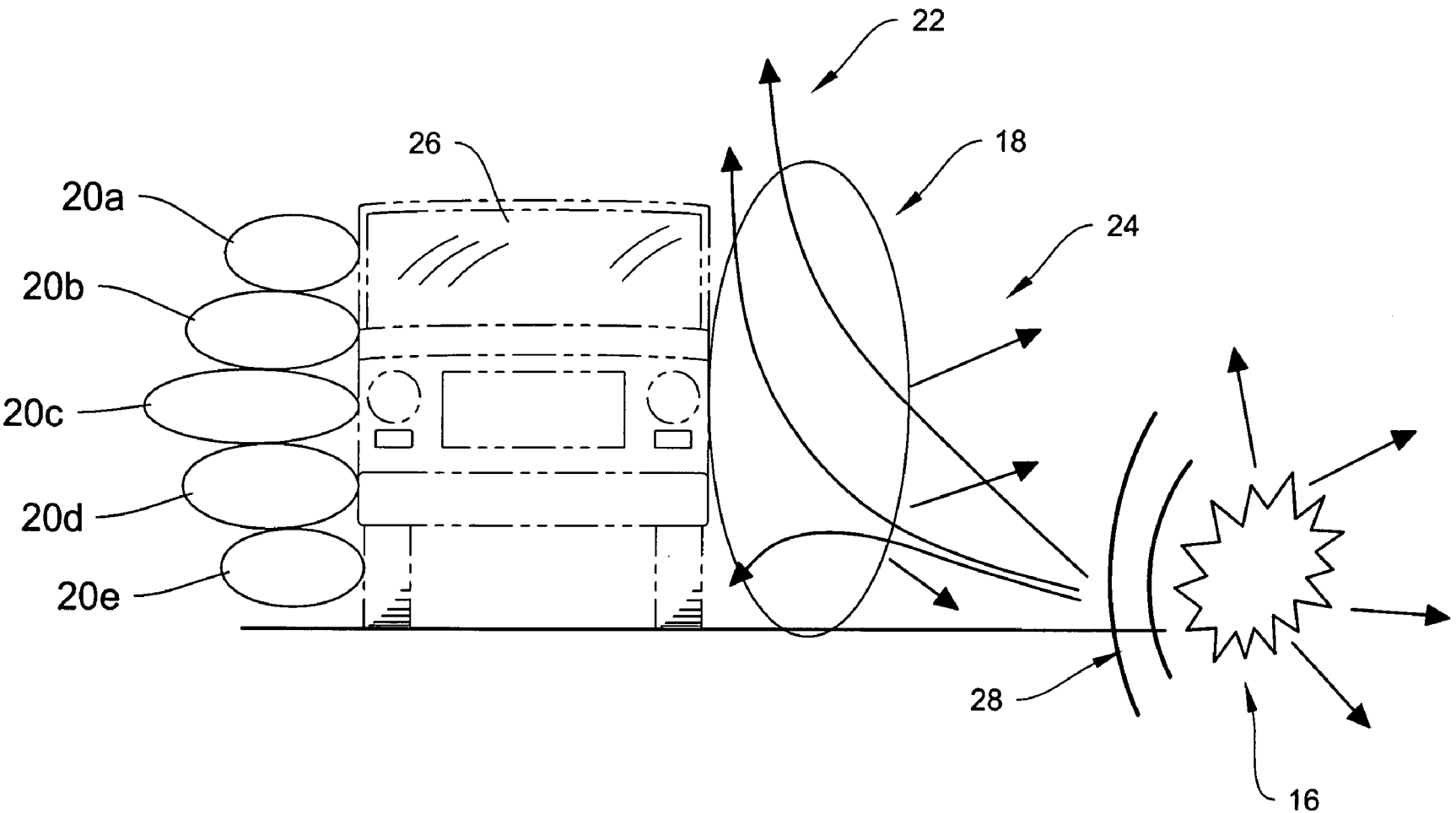
FIG. 3 is a conceptual drawing illustrating additional shock wave attenuation achieved by employing a low density gas lens external to a confined space, such as the space of FIG. 2, according to a further illustrative embodiment of the invention.

FIG. 3 is a conceptual drawing 12 illustrating shock wave attenuation achieved by employing a low density gas lens according to a further exemplary embodiment of the invention. In a similar fashion to the embodiment of FIG. 2, according to the approach of FIG. 3, the invention detects an explosion 16 via infrared and/or ultraviolet detectors. In response to detecting the explosion 16, the invention interposes a low density gas lens 18 between the target 14 and the explosion 16. According to one implementation, the gas lens 18 is formed from a single bladder. In other embodiments, the gas lens 18 may be formed from a plurality of bladders, such as the bladders 20*a*-20*e* (collectively, the lens 20), shown for illustrative purposes on an opposite side of the target 14. It should be noted that for a single inflatable gas lens 18 having a diameter/thickness greater than the principal wavelength of the shock wave, reflection and transmission are the acoustical processes that dominate with regard to determining the effectiveness of the lens. However, for multiple inflatable lenses 20*a*-20*e*, each having a diameter/thickness less than the wavelength of the shock wave, scattering and refraction are the acoustical processes that dominate the effectiveness of the lens.

The bladders may be made, for example, from any suitable flexible polymer. According to one implementation, the bladders are formed from Mylar. According to the illustrative embodiment of FIG. 3, the invention inflates the lens 18 with a low impedance gas, such as helium or argon, in response to detecting the explosion 16. The illustrative lens 18 is convex and refracts 22, reflects 24 and otherwise disperses the shock wave 28 from the explosion 16 away from the target 14.

Implementations that inflate the bladders 18 and/or 20*a*-20*e* upon explosion detection are particularly suited for use with mobile targets, such as an individual soldier, or land, water, or air vehicle, in that the bladders may be maintained normally in a stored compact state, and the gas stored in one or more compressed containers. However, where a stationary target, such as a building, is to be protected, it may be desirable to maintain the protective lens or lenses in an inflated deployed state. An advantage of maintaining the lens 18 or 20 in a deployed state is that the protection is always in place and there is no response time delay associated with deploying the lens. Since inflation time is not critical, the protective bladders of a continuously deployed lens may be much larger. As shown, the illustrative embodiment of FIG. 3 also employs low impedance gas fill 26, such as that described with regard to FIG. 2.

Figure 4:
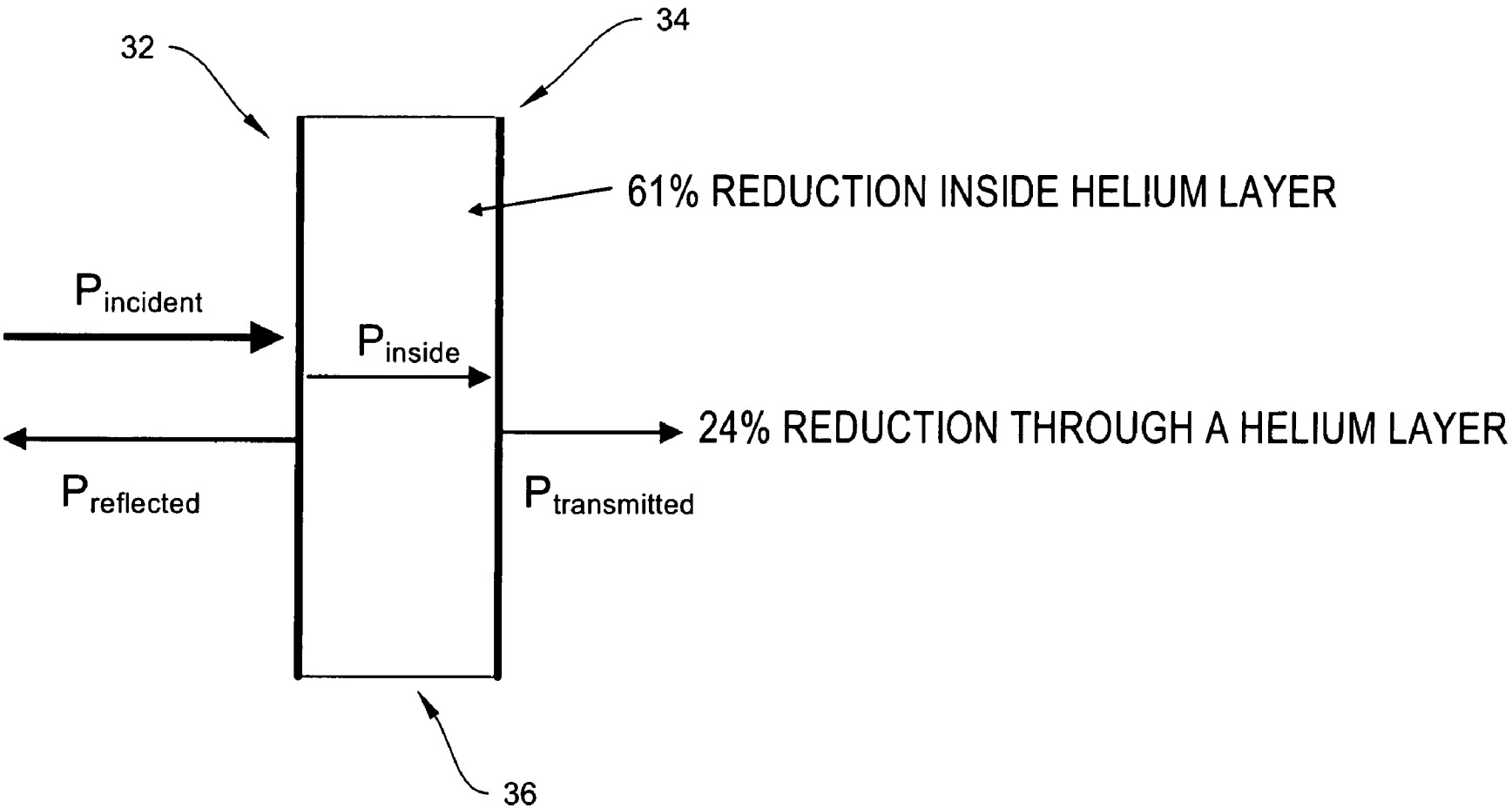
FIG. 4 depicts an illustrative lens geometry employing substantially flat back and front lens surfaces.
Figure 5:
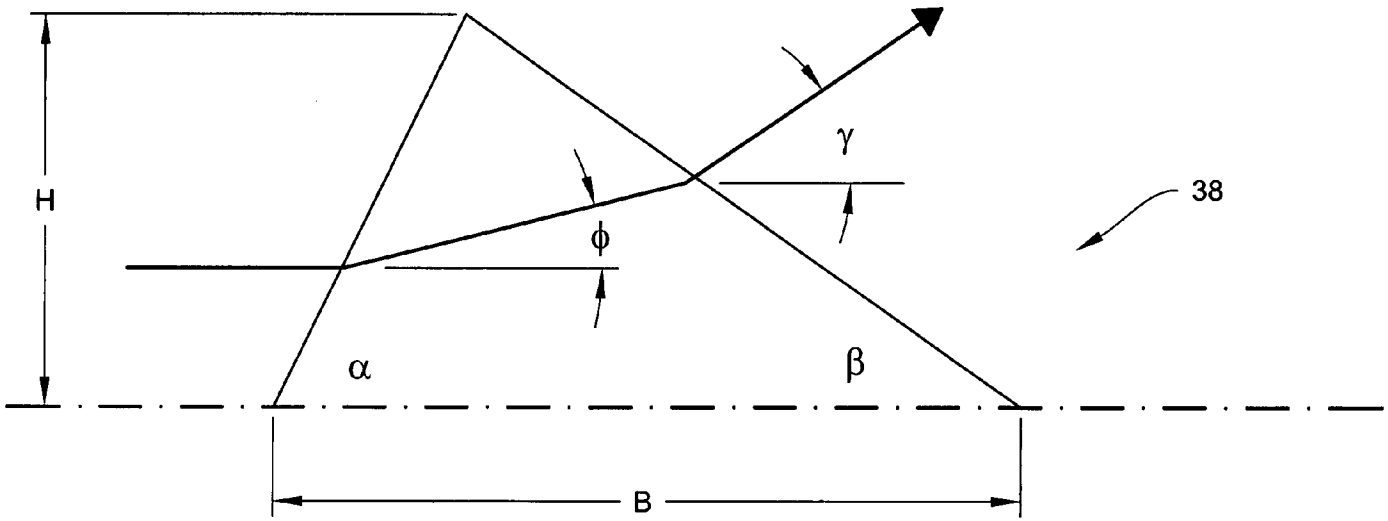
FIG. 5 depicts and illustrative lens geometry employing a single inflatable bladder to form a 3-dimensional convex lens.
Figure 6:
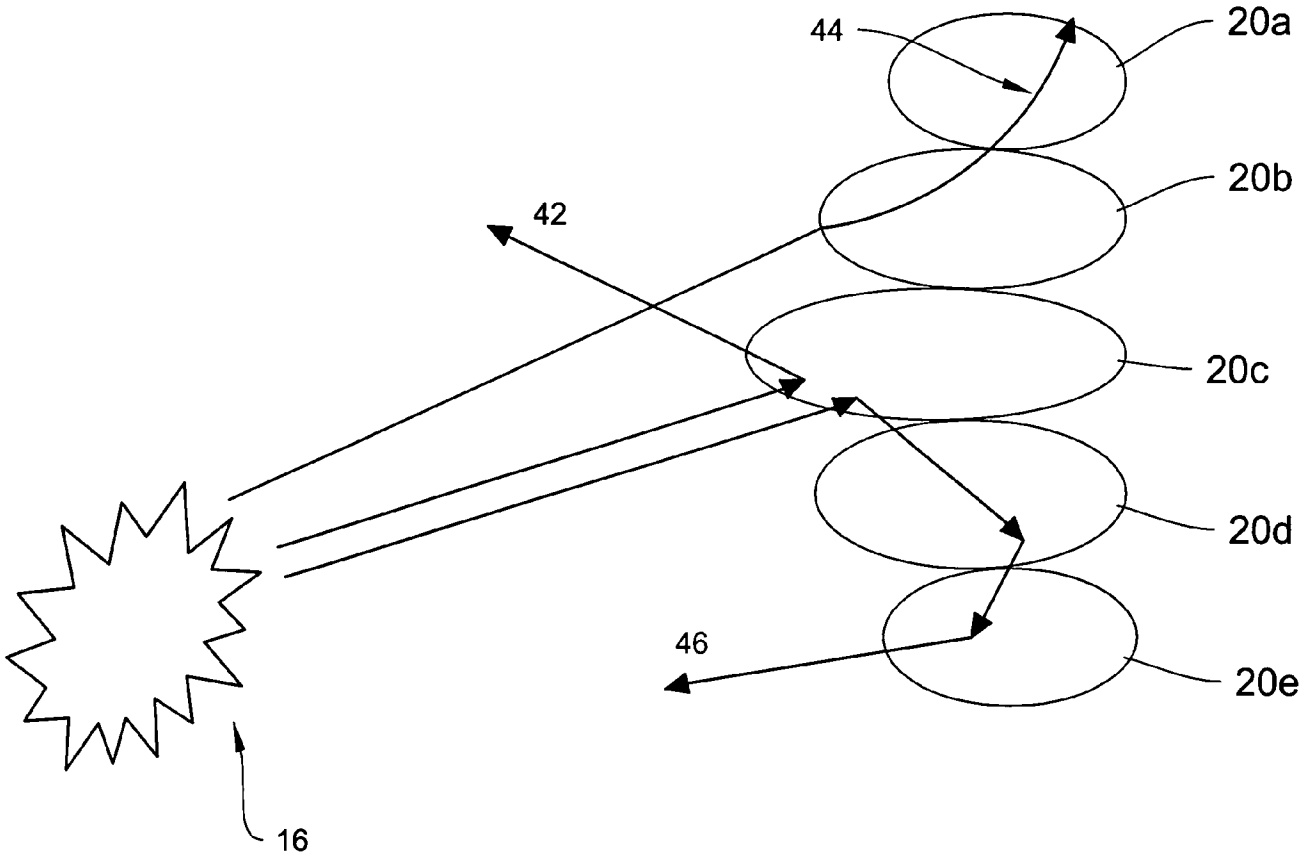
FIG. 6 depicts and illustrative lens geometry employing a plurality of inflatable bladders.

The reflection, refraction, dispersion characteristics of the lenses 18 and 20 may be adjusted by use of differing lens geometries. FIGS. 4-6 depict three illustrative lens geometries providing three different characteristics. More particularly, FIG. 4 shows a lens geometry 30 where both front 32 and back 24 surfaces of the lens 30 are substantially flat. As would be expected, as in the example of FIG. 2, a reduction in overpressure of about 61% occurs in the helium filled space 36. However, this geometry only provides about a 24% reduction in transmitted overpressure.

FIG. 5 depicts an alternative illustrative geometry 28 for a low impedance gas lens, such as the lens 18 of FIG. 3. According to this geometry, one objective is to make the diffracted angles Φ and γ to be about equal, while constraining the volume (V) of gas that it takes to fill the lens. It should be noted although depicted in two dimensions, the geometry 28 is a body of revolution. According to the illustrative embodiment of FIG. 5, $$\phi = \sin^{-1}\left[\frac{c_H}{c_a}\cos(\alpha)\right] - \frac{\pi}{2} + \alpha$$

$$\gamma = \frac{\pi}{2} - \beta - \sin^{-1}\left[\frac{c_a}{c_H}\cos(\beta + \phi)\right]$$

$$V = \frac{\pi}{3}H^3(\cot(\alpha) + \cot(\beta))$$

where, $c_H$=speed of sound in helium, and $c_a$=speed of sound in air.

With $\alpha \approx 75°$, $\beta \approx 40°$, $B \approx 4$ meters, and $H \approx 2$ meters, the geometry 38 can realize about a 66% reduction in transmitted overpressure.

FIG. 6 depicts an illustrative lens geometry 40 employing the multiple bladder 20*a*-20*e* configuration of FIG. 3. The multiple bladder configuration provides further improved reflection 42, refraction 44 and dispersion 46 characteristics over the single bladder embodiment of FIG. 5, with a reduction in transmitted overpressure exceeding 66%.

Figure 7:
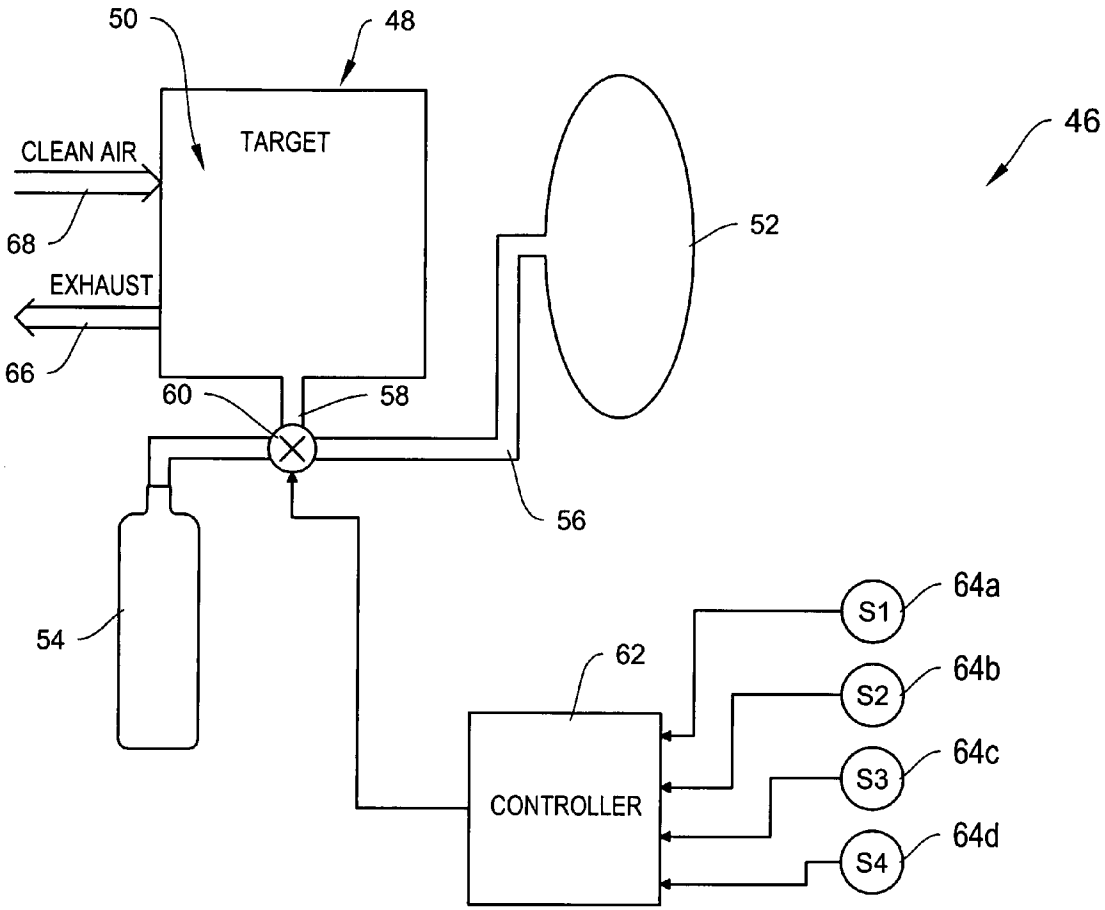
FIG. 7 is a functional block diagram of a shock wave damage mitigation system employing both a release of a low density/impedance gas into a contained environment and an external gas lens according to an illustrative embodiment of the invention.

FIG. 7 is a functional block diagram of a system 46 for mitigating damage done by a shock wave to a target 48 according to an illustrative embodiment of the invention. According to the illustrative depiction, the target 48 is a building including an interior space 50. However, the target may be any target disclosed supra. Additionally, for illustrative purposes, the various functional blocks are shown as being separate components. However, any of the components may be combined into an integrated system, for example, such as a portable system integrated into a soldier's body protection or into a structure of a vehicle.

The system 46 includes an inflatable bladder 52 (or alternatively, a plurality of inflatable bladders). The system 46 also includes a low impedance gas supply 54 for inflating the bladder 52, by way of the check valve 60 and the conduit 56. The system 46 also provides a conduit 58 for supplying the low density gas 54 to the interior space 50 of the target 48. An exhaust system 66 vents the low impedance gas 54 from the interior space 50 subsequent to the shock wave passing. An air ventilation system 68 provides clean air to the interior space 50 as the exhaust system 66 vents the gas 54 out of the space 50. Sensors 64*a*-64*d*, such as ultraviolet and/or infrared sensors, detect any explosions occurring in the vicinity of the target 48. In response to a detected explosion, a controller 62 opens the valve 60 to fill both the space 50 and the lens 52 with the low impedance gas 54. As mentioned above, in some embodiments, the lens 52 may be maintained in a filled state at all times, thus eliminating the need to fill it in response to an explosion detection.

Figure 8:
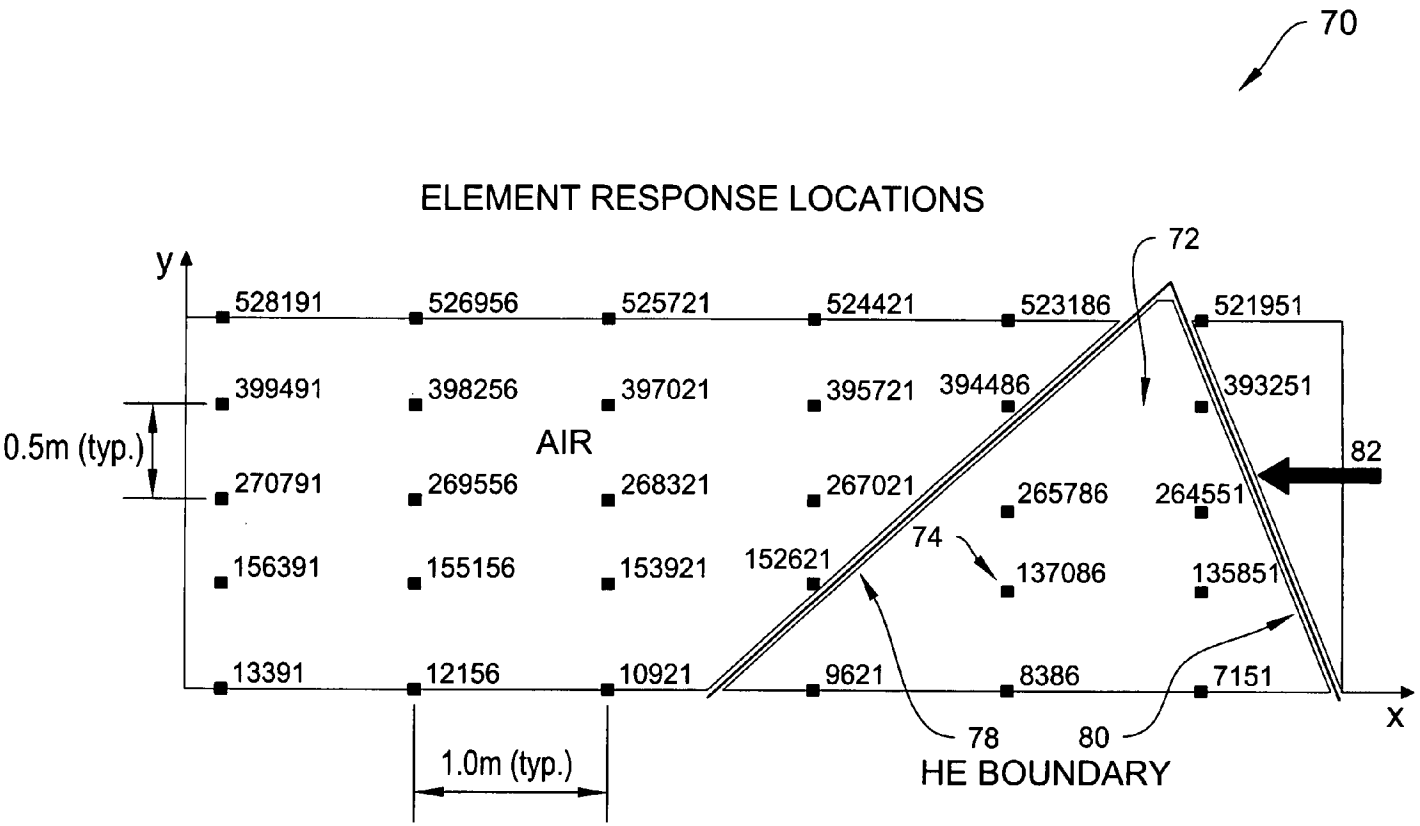
FIG. 8 shows response locations at particular distances from the illustrative low density gas lens geometry of FIG. 5.

FIG. 8 is a graph 70 showing response locations within a low density gas lens 72 (e.g., response location 74) and at particular distances and angles from the lens 72 (e.g., response location 76). The helium boundaries are indicated at 78 and 80, and the arrow 84 indicates the general direction which the blast wave is propagating. As indicated, there is about 1 meter between the response locations along the x-axis and about 0.5 meter between the response locations along the y-axis. The gas employed for the illustrative example is helium.

Figure 9:
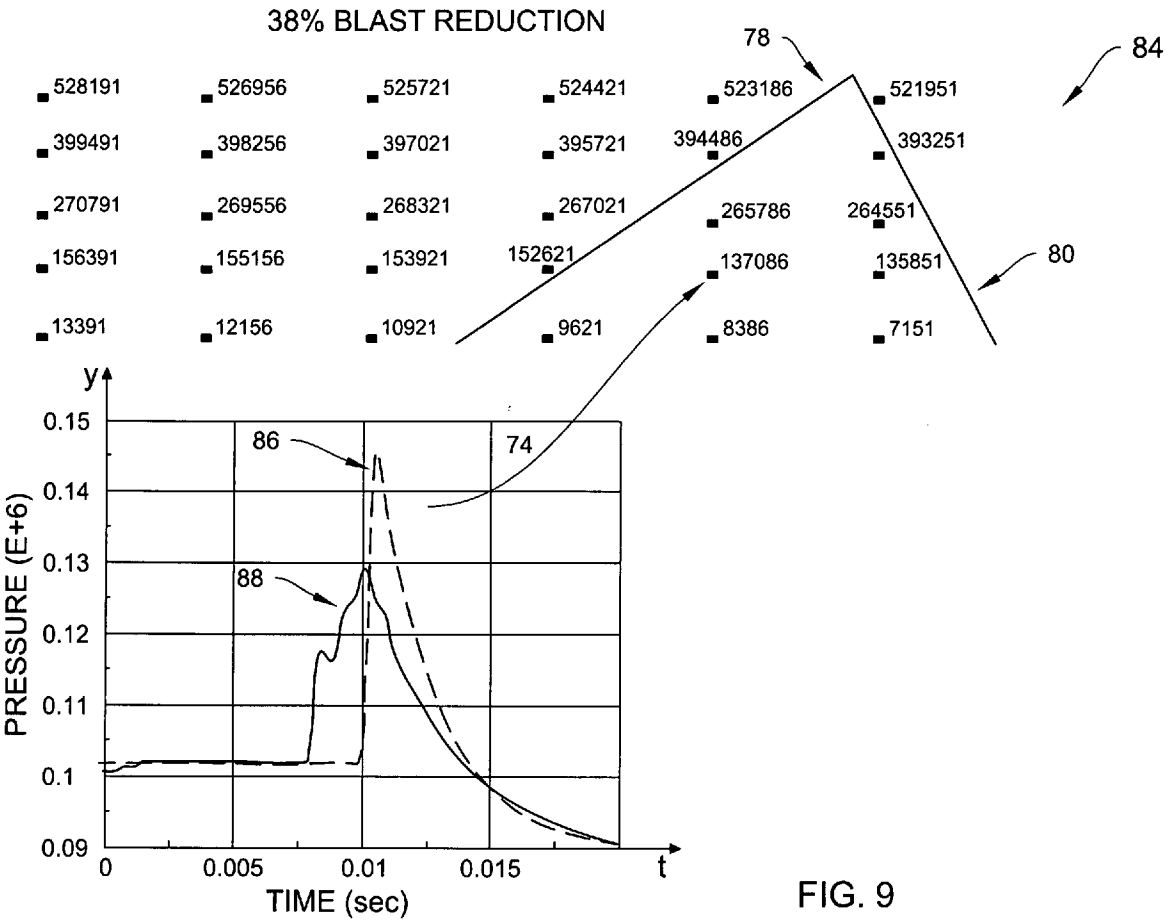
FIG. 9 is a graph depicting an overpressure reduction of 38% achieved at a particular one of the response locations shown in FIG. 8 using the illustrative low density gas lens geometry of FIG. 5.

FIG. 9 is a graph 84 depicting pressure on the y-axis and time on the t-axis, and indicating overpressure as a function of time occurring at the response location 74 resulting from an explosive blast wave. The trace 86 indicates a baseline overpressure occurring at the response location 74 with the lens filled with air, while the trace 88 indicates the overpressure occurring with the lens filled with helium. As shown, employing a low impedance gas lens having a geometry of the type discussed with regard to FIG. 5 provides about a 38% reduction in overpressure occurring at the response location 74.

Figure 10:
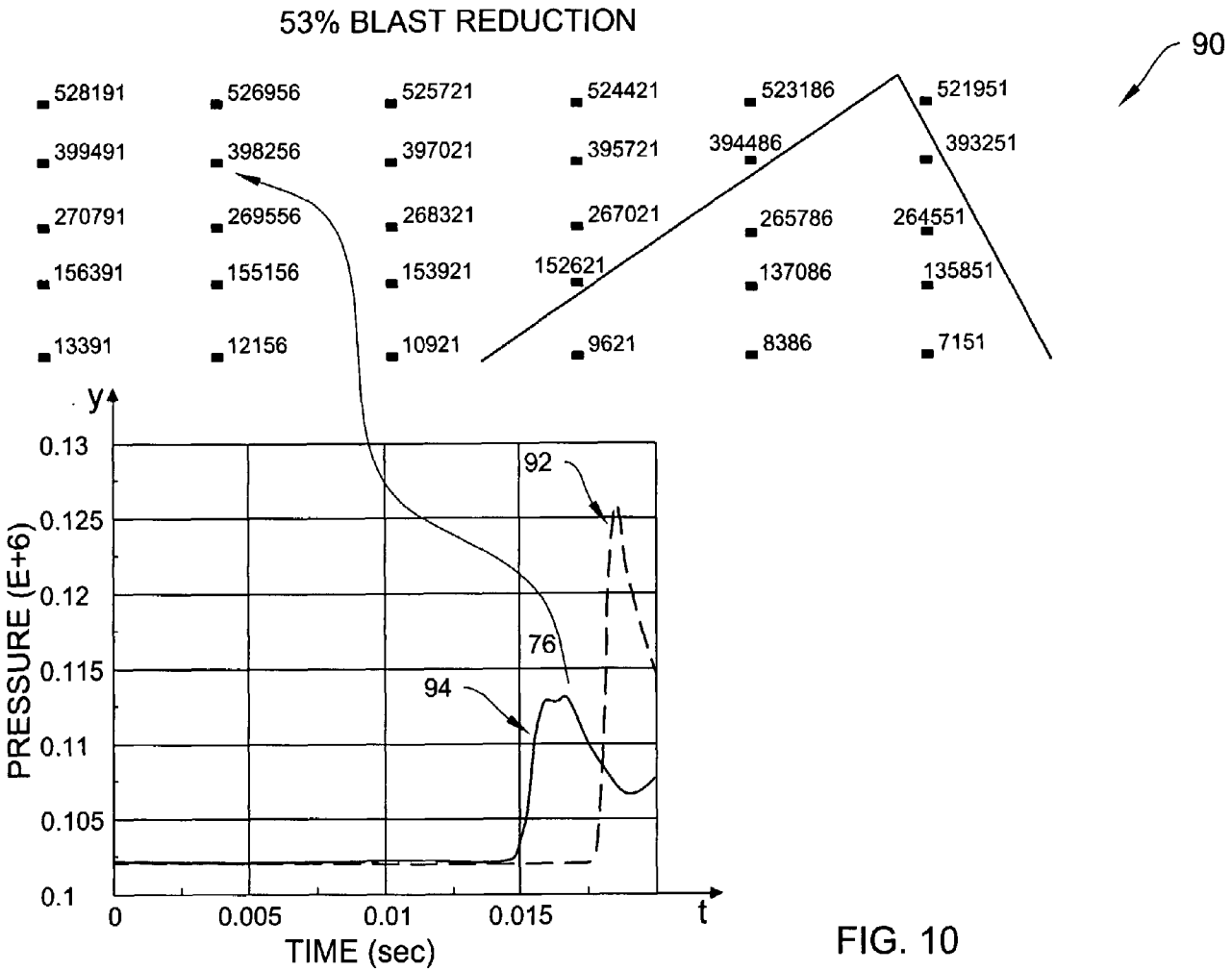
FIG. 10 is a graph depicting an overpressure reduction of 53% achieved at another of the response locations shown in FIG. 8 using the illustrative low density gas lens geometry of FIG. 5.
Figure 11:
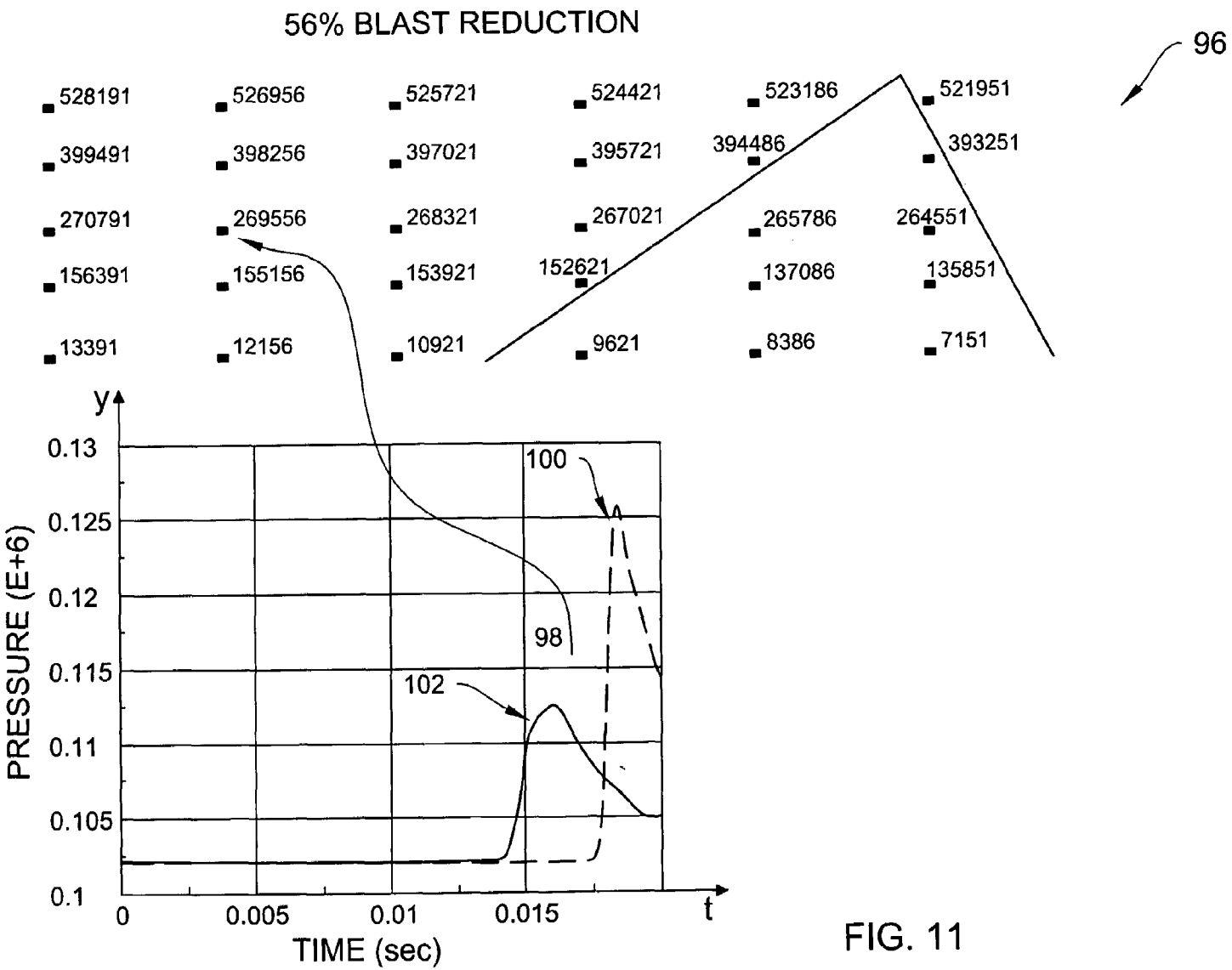
FIG. 11 is a graph depicting an overpressure reduction of 56% achieved at another of the response locations shown in FIG. 8 using the illustrative low density gas lens geometry of FIG. 5.

FIG. 10 is a graph 90 of the type depicted in FIG. 9 and depicting the overpressure experienced at the response location 76. In this graph, the trace 92 indicates the baseline overpressure occurring at the response location 76 with the lens filled with air, while the trace 94 indicates the over pressure occurring with the lens filled with helium. As shown, there is about a 53% reduction in overpressure at the response location 76. FIG. 11 provides an additional graph 96 of a similar type, but depicting the overpressure experienced at a response location 98 located about 0.5 meter below the response location 76 in FIG. 10. In the graph 96, the trace 100 indicates the baseline overpressure occurring a the response location 96 with the lens filled with air, while the trace 102 indicates the overpressure occurring with the lens filled with helium. As shown, there is about a 56% reduction in overpressure with helium versus with air at the location 98. The differing overpressure reductions at differing locations indicates that to afford maximum protection, the lens should be positioned such that the maximum overpressure reduction occurs where the most easily damaged body parts of a soldier are located. (e.g., near the head and neck of a soldier driving a land vehicle).

Figure 12A:
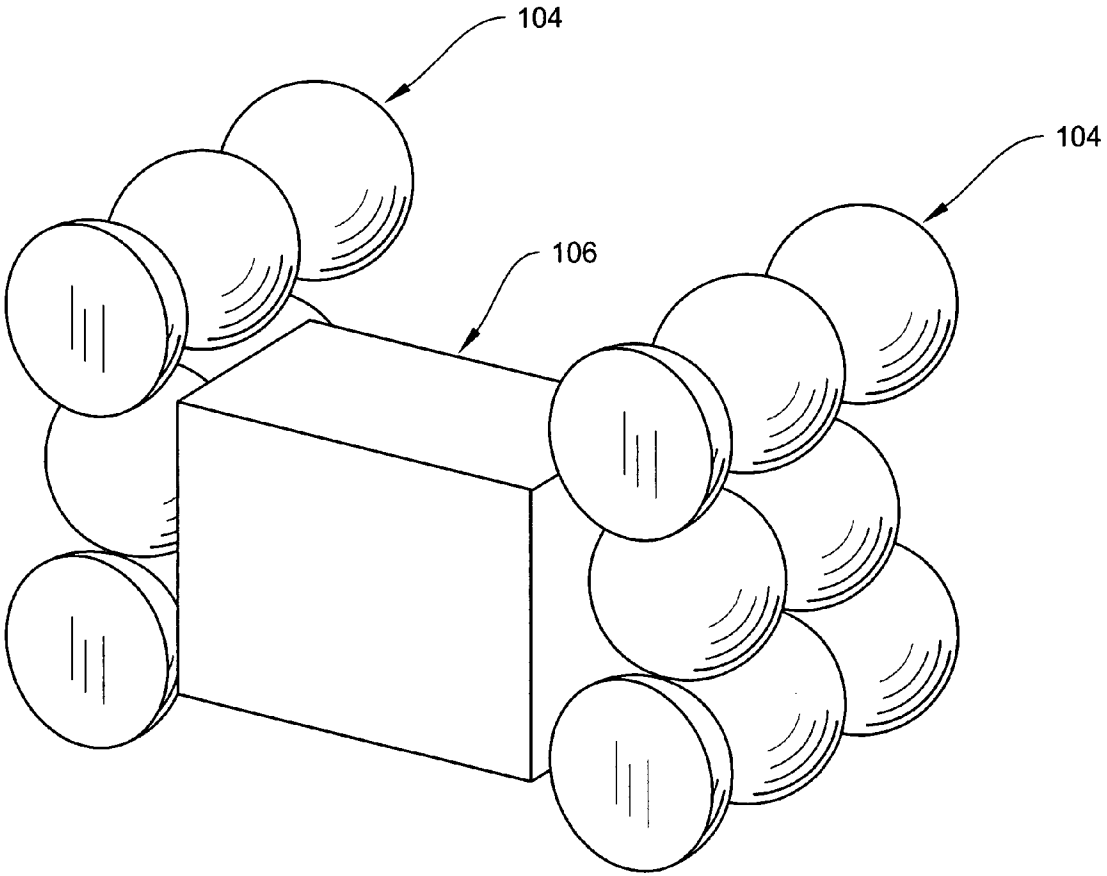
FIG. 12A is a conceptual drawing showing a low density gas lens formed using inflatable structures on either side of a motor vehicle according to an illustrative embodiment of the invention.
Figure 12B:
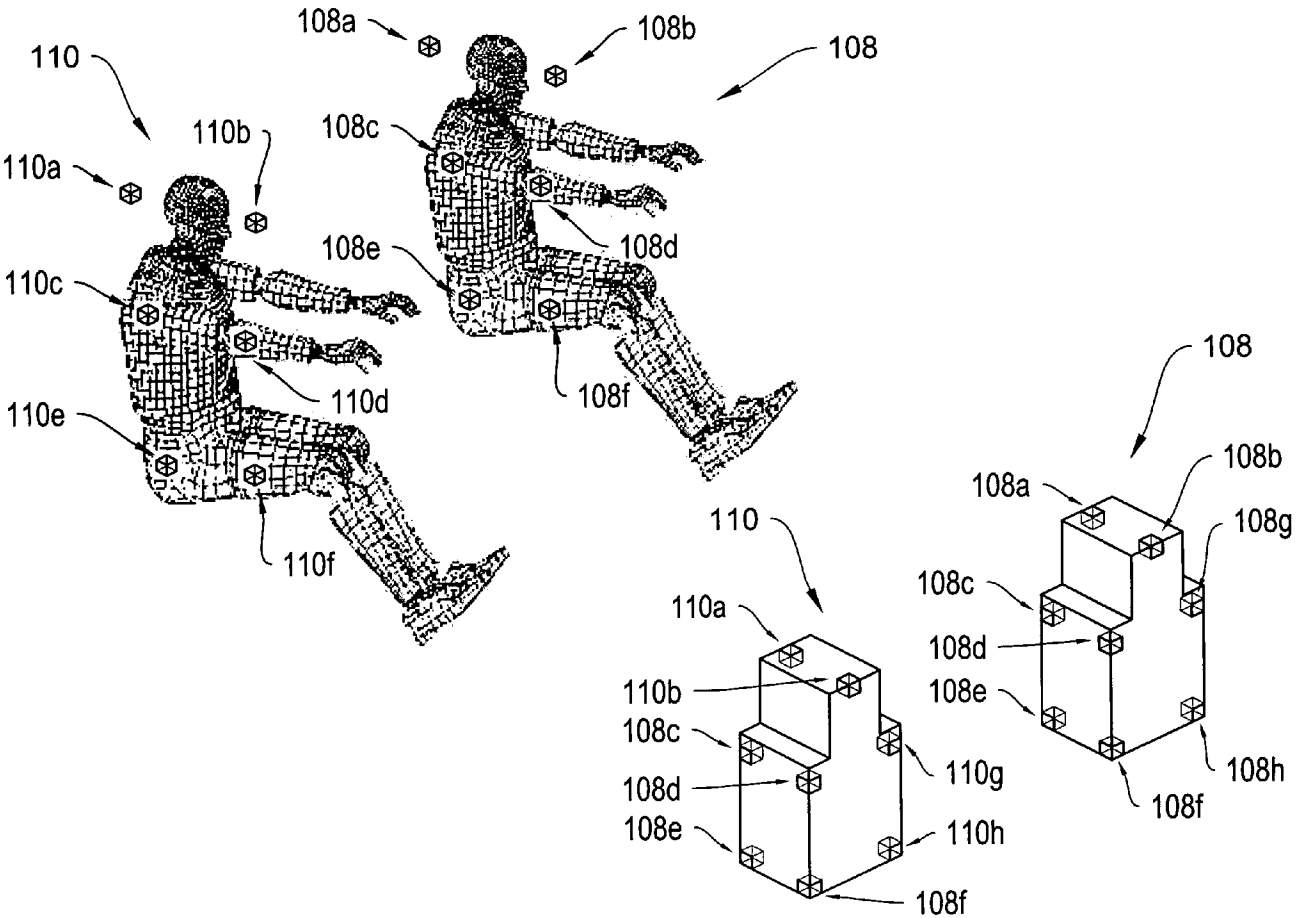
FIG. 12B is a conceptual drawing showing two soldiers locations within the vehicle of FIG. 12A and how those locations map to pressure response locations on their bodies.
Figure 13:
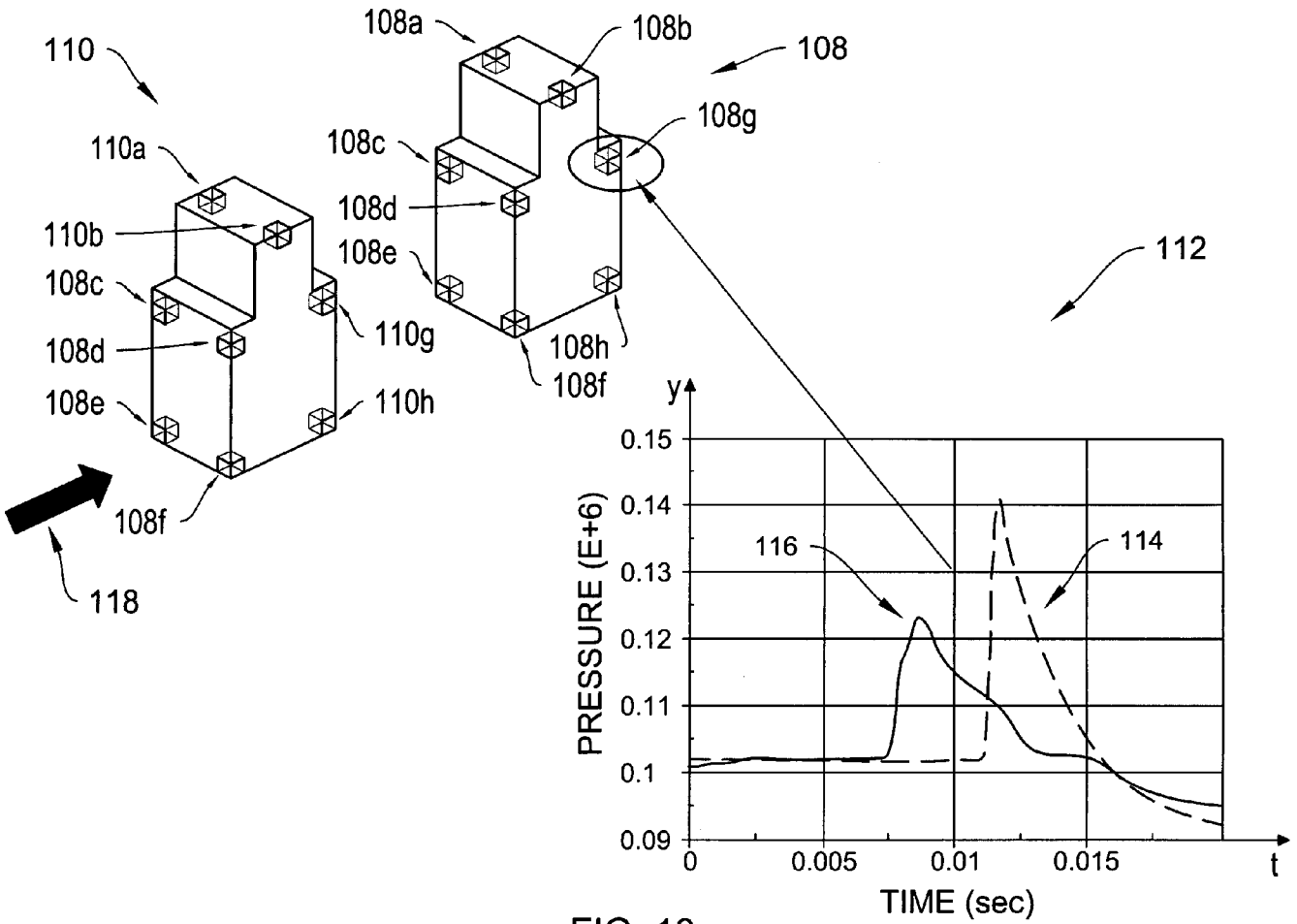
FIG. 13 is a graph depicting an over pressure reduction of 50% achieved near the upper front torso of one of the soldiers of FIG. 12B resulting from use of the low density gas lens of FIG. 12A.
Figure 14:
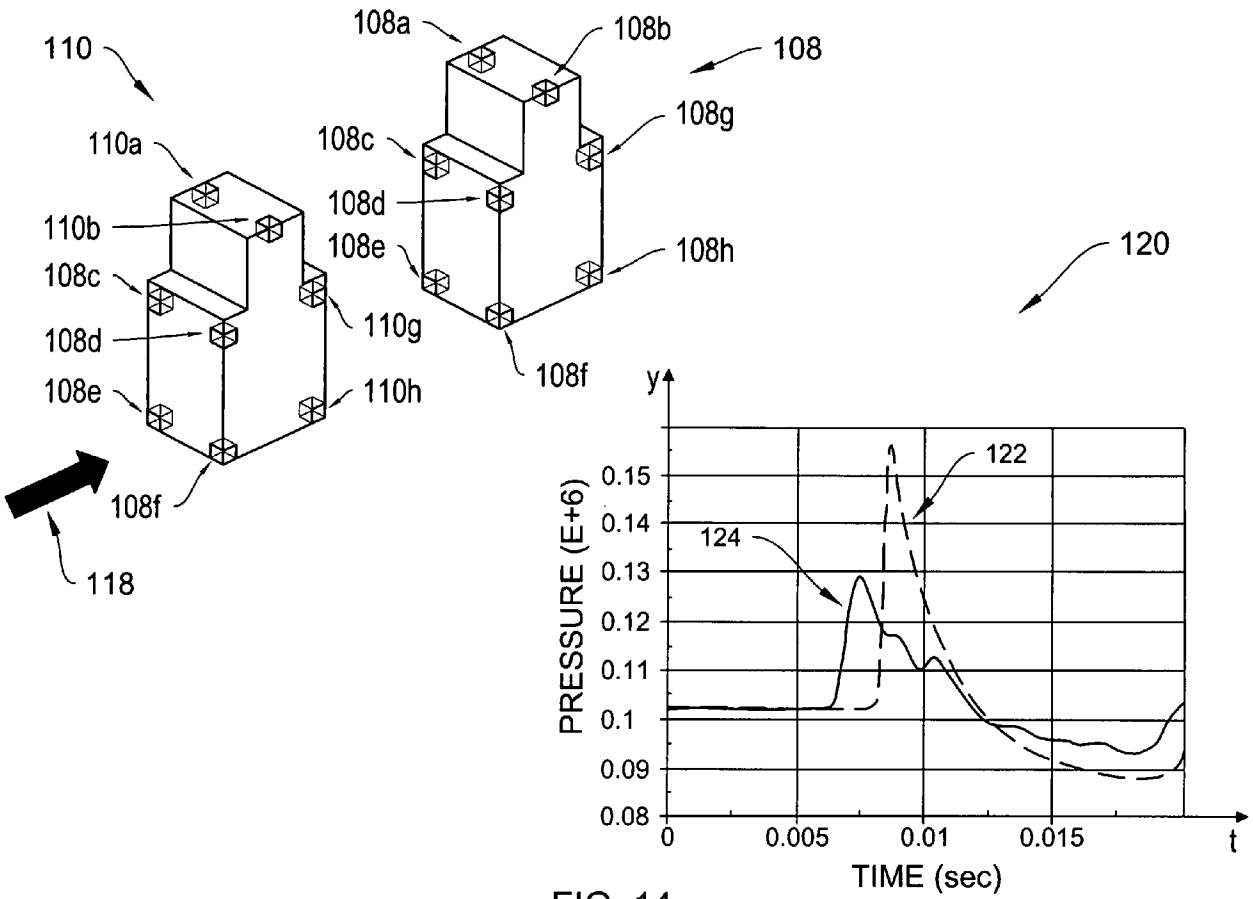
FIG. 14 is a graph depicting an over pressure reduction of 55% achieved near the front of the head of one of the soldiers of FIG. 12B resulting from use of the low density gas lens of FIG. 12A.

FIG. 12A is a conceptual drawing showing a low density gas lens formed using a plurality of 1 meter diameter inflatable structures 104 on either side of a motor vehicle 106 according to an illustrative embodiment of the invention. For illustrative purposes, the structures 104 are inflated with helium. However, as discussed above, any suitable low impedance gas may be used. FIG. 12B is a drawing showing the locations of two soldiers 108 and 110 within the vehicle of FIG. 12A, and conceptualized to indicate sensor locations 108*a*-108*h* and 110*a*-110*h* on the soldiers 108 and 110, respectively. FIGS. 13 and 14 are graphs of the type depicted in FIGS. 9-11 indicating overpressures experienced by the soldiers 8 and 10 at differing locations. More particularly, FIG. 13 is a graph 112 shows the overpressure experienced at the response location 108*g* on the soldier 108. The location 108*g* corresponds approximately to the left shoulder of the soldier 108. The arrow 118 indicates the direction of travel of the explosive shock wave. The trace 114 indicates the baseline overpressure experienced at the location 108*g* as a function of time, with the spheres 104 filled with air, while the trace 116 indicates the overpressure experienced at location 108*g* with the spheres 104 filled with helium. As can be seen, the helium filled spheres provide about a 50% reduction in the overpressure experienced at this location. FIG. 14 shows a similar graph 120 depicting the over pressure experienced at the response location 110*b*, corresponding to a location behind the shoulder of the soldier 110. The trace 122 indicates the baseline overpressure experienced at the location 110*b* as a function of time, with the spheres 104 filled with air, while the trace 124 indicates the overpressure experienced at location 110*b* with the spheres 104 filled with helium. As indicated, there is about a 55% reduction in overpressure at this location.

Figure 15:
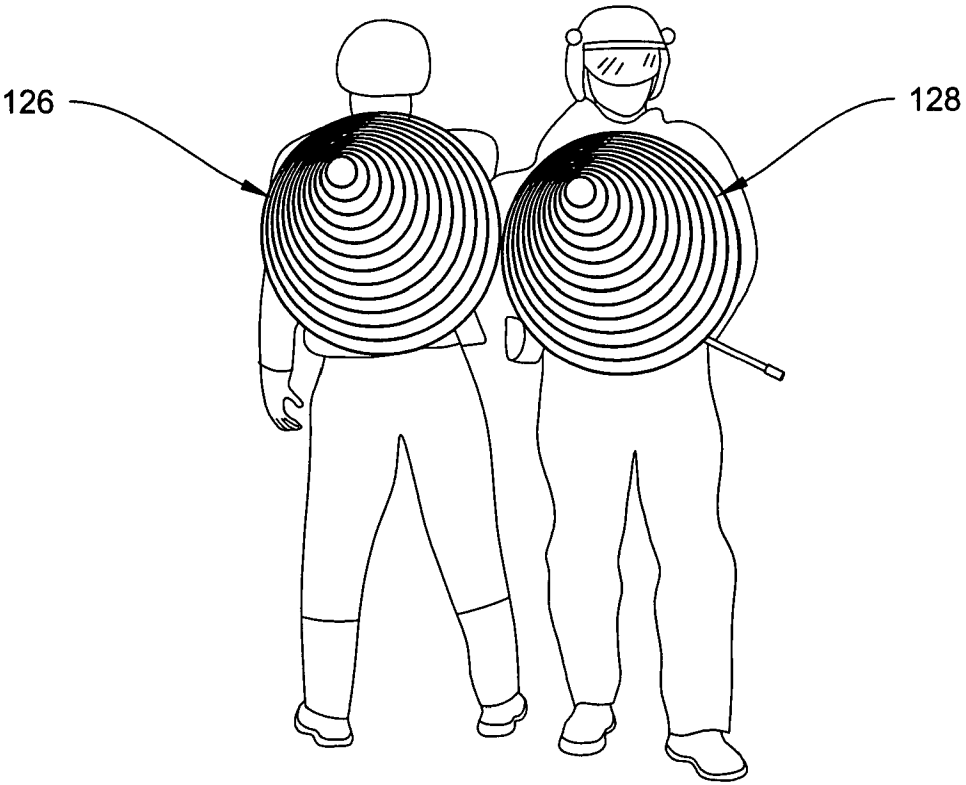
FIG. 15 is a conceptual drawing of the deployment of a low density gas lens as personal body protection according to an illustrative embodiment of the invention.

FIG. 15 is a conceptual drawing of deployed low density gas lenses 126 and 128 on the front and back, respectively, of a soldier as augmentation to personal body protection according to an illustrative embodiment of the invention. In this illustrative example, the lenses 126 and 128 are normally maintained in a compact stowed location on the soldier and a the soldier carries sufficient gas to inflate the less than about 1 meter in diameter spheres. Sensors, such as infrared and/or ultraviolet sensors are also mounted on the soldier's gear to provide early detection of an explosion sufficient to cause a harmful shock wave. In response to such detection, the lenses 126 and 128 are automatically inflated.

Figure 16:
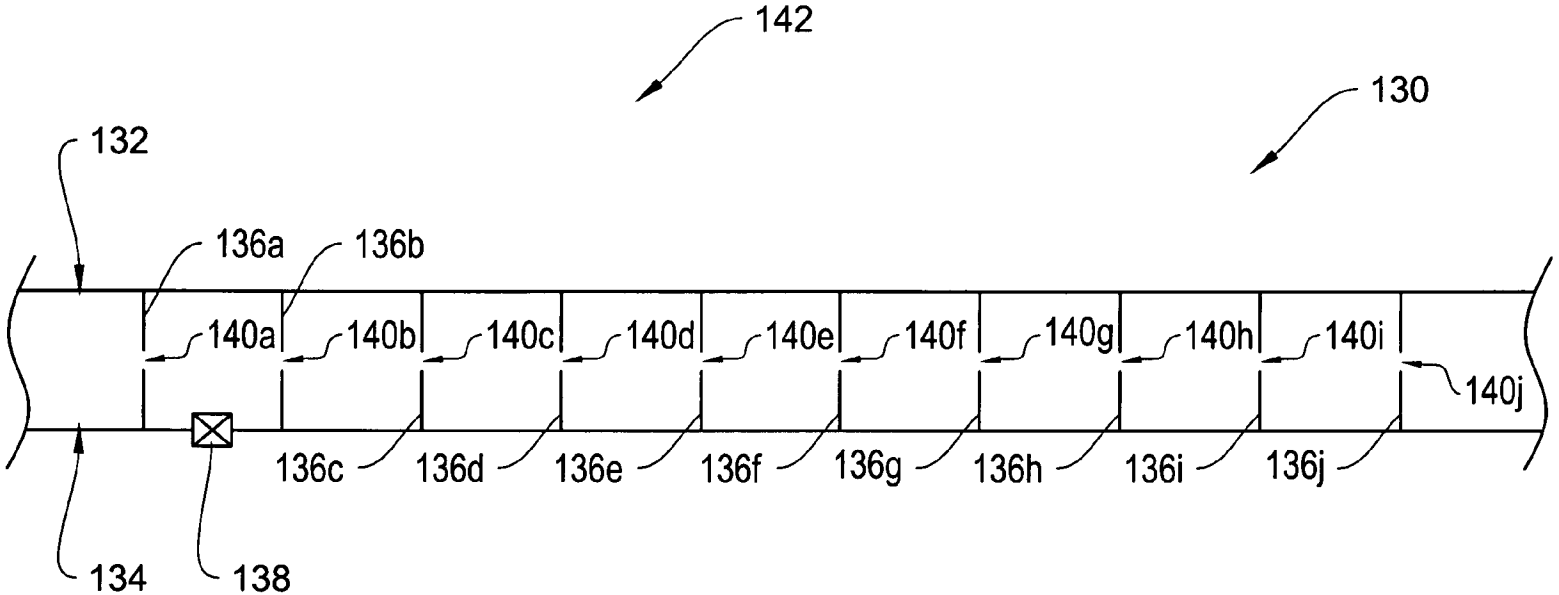
FIG. 16 is a conceptual drawing of a low density gas lens of the invention being formed integrally into an fabric.

According to another illustrative embodiment, the invention provides an inflatable fabric 142 for forming a low acoustic impedance gas lens. FIG. 16 depicts a cross-sectional view of an inflatable fabric 142 according to an illustrative embodiment of the invention. As shown, the fabric 142 has a top side 132 and a bottom side 134. Baffles 136*a*-136*j* run the length of the fabric 142 for connecting the top side 132 to the bottom side 134. Apertures 140*a*-140*j* provide fluid communications between sections of the fabric separated by the baffles 136*a*-136*j*. The fabric 142 also includes a valve 138 for fluidly connecting to a supply of a low impedance lens gas. The fabric 142 may be formed of any material capable of providing a gas-tight or substantially gas-tight seal to contain the lens gas. In various illustrative examples, the fabric may be formed into structures such as blast bags for being interposed between a target and an explosion or for covering an explosive to provide blast wave mitigation as described supra. In other illustrative embodiments, the fabric may be formed into garments for augmenting personal body armor or into walls or roofs for portable buildings, such as tents. In the case of augmentation to personal body armor, the fabric 142 may be automatically inflated via a personal lens gas supply in response to detecting an explosion. Such inflation may be similar to that of a floatation vest. In the case of being used for stationary objects, the fabric may be maintained in an inflated state to alleviate any deployment response time delay and to maintain the lens gas in a relatively warmer state. According to some illustrative embodiments, a structure formed with the fabric 142 may be erected and then inflated to provide blast wave protection.

According to one illustrative embodiment, the gas-filled fabric 142 has a thickness greater than the wavelength of the blast wave, and provides similar blast wave mitigation characteristics to those described above with regard to inflatable bladders. However, in alternative illustrative embodiments, the thickness of the gas-filled fabric is less than the wavelength of the blast wave. In this case, the transmitted pressure is given by:

$$\frac{P_{trans}}{P_{incident}} = \frac{1}{\sqrt{\left(1 + \left(\frac{Z \cdot \omega \cdot t}{2 \cdot \gamma \cdot P_{amb}}\right)^2\right)}}$$

where Z is the specific acoustic impedance of ambient air, $\gamma$ is the adiabatic gas constant, $P_{amb}$ is the ambient pressure, and $\omega=2\pi \cdot f$, where f is a characteristic shockwave frequency.

Assuming a typical dominant frequency in a shock wave of $f \approx 5$ kHz ($\omega \approx 3.14 \cdot 10^4$ rad/sec), $\gamma \approx 1.5$ for helium, and a thickness of the fabric 142 of t=1.25 cm, one obtains $P_{trans}/P_{incident} \approx 0.86$, i.e., a reduction in the peak overpressure of 14%.

However, the reduction for a relatively thin helium-filled fabric may be improved by providing a fabric with substantial mass. For example, in one illustrative embodiment, the top 132 and bottom 134 layers are the same, and have a thickness h and are made from material with mass density $\rho_f$. The two layers are separated by distance t. The ambient pressure is $P_{amb}$ and the adiabatic gas constant is $\gamma$. The transmission ratio for transmitted sound is T, and this is a function of frequency $\omega=2\pi \cdot f$. The specific acoustic impedance of air is $\rho c$ and the blast wave incidence angle is $\theta$. The equation for the magnitude of the transmission ratio is given by:

$$T(\omega) = \left| \frac{2\omega \cdot Z}{k\left[\left(\frac{i\omega \cdot Z}{k} + 1 - \frac{\omega^2 M}{k}\right)^2 - 1\right]} \right| \text{ where}$$

$$k = \frac{\gamma P}{t} \text{ and } M = \rho_f h \text{ and } Z = \frac{\rho c}{\cos(\theta)}$$

Exemplary parameter values are for a fabric having a mass density 1000 kg/m$^3$, a thickness of 1 mm, and the top 132 and bottom 134 layers are separated by about 2.5 cm. The gas between fabric layers is air at atmospheric pressure and the blast wave incidence angle is 0° (normal incidence).

Figure 17:
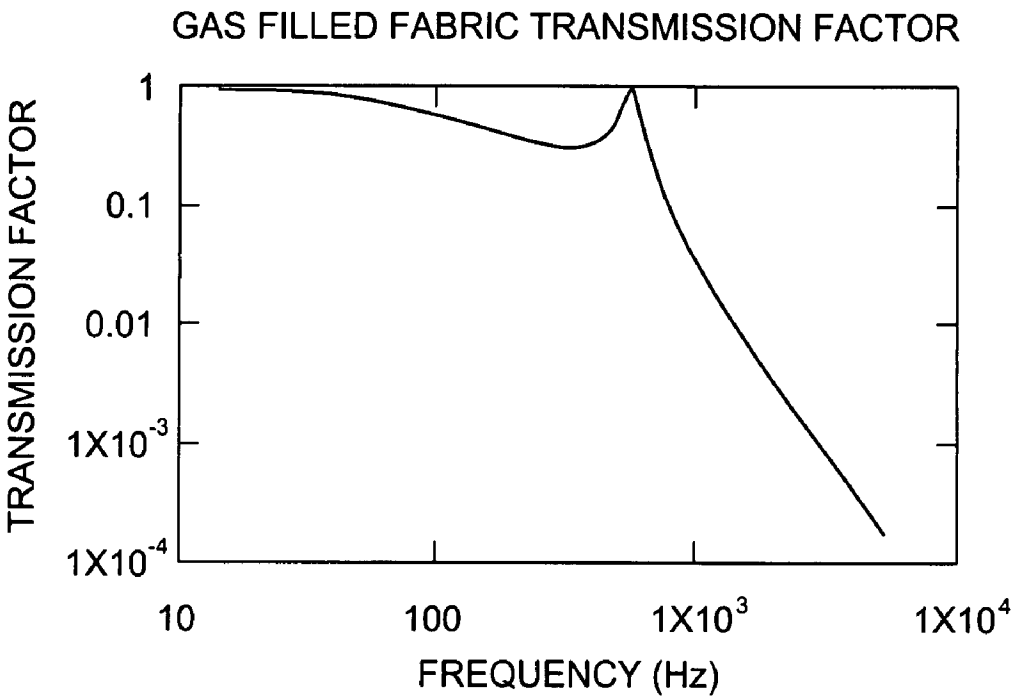
FIG. 17 is a graph depicting blast wave mitigation characteristics for a gas-filled fabric of the type depicted in FIG. 16.

As shown in the graph of FIG. 17, more than 90% of the incident blast wave pressure components are removed at frequencies higher than about 800 Hz. About 90% of blast wave pressure components are at frequencies above 800 Hz, so that this about 2.5 cm thick fabric, when inflated, reduces the peak blast overpressure by at least about 80%.

According to another illustrative embodiment, the invention decreases the specific impedance of a gas by heating it. More particularly, the density of a gas is inversely proportional to the absolute temperature of the gas, and speed of sound is proportional to the square root of the absolute temperature, so that the acoustic impedance is inversely proportional to the square root of the temperature. For example, if the ambient temperature is 20° C., (293 K), then the acoustic impedance of air heated to 1000 K will drop to 238 Pa·s/m. Thus, a volume of air heated in this manner will have a much greater speed of sound than the ambient air, and will act like a lens and refract a shock wave. In one illustrative embodiment, the invention directs a flame, for example, from a flame thrower toward the source of the shock wave to heat the air between the shock wave source and the target to be protected.

Thus, it can be seen from the above description that the invention, in various illustrative embodiments, provides improved systems, methods and devices for reducing damage to both human beings and structural components from overpressure occurring as a result of an explosive blast wave.

What is claimed is:

1. A method of mitigating damage from an explosion comprising, detecting an explosion external to a substantially contained environment, in response to detecting the explosion, substantially filling the environment with a gas having a specific impedance less than about 350 Pascal seconds/meter (Pa·s/m) to attenuate a peak overpressure within the environment resulting from a shock wave caused by the explosion, and venting the gas from the environment subsequent to the shock wave passing the environment.

2. The method of claim 1, wherein the gas includes at least one of helium and argon.

3. The method of claim 1, wherein the gas is heated.

4. The method of claim 1 including detecting the explosion with at least one of an ultraviolet and an infrared detector.

5. The method of claim 1, wherein the substantially contained environment is an environment selected from the group consisting of an interior of a land vehicle, an interior of a watercraft, an interior of an aircraft, and an interior portion of a building.

6. A system for mitigating damage from an explosion comprising, a detector for detecting an explosion external to a substantially contained environment, and a supply of a gas having a specific impedance of less than about 350 Pa·s/m for substantially filling the environment in response to detecting the explosion to attenuate a peak overpressure within the substantially contained environment resulting from a shock wave caused by the explosion, and a vent for venting the gas from the substantially contained environment.

7. The method of claim 6, wherein the gas is heated.

8. The system of claim 6, wherein the gas includes at least one of helium and argon.

9. The system of claim 6 including detecting the explosion with at least one of an ultraviolet and an infrared detector.

10. The system of claim 6, wherein the substantially contained environment is an environment selected from the group consisting of an interior of a land vehicle, an interior of a watercraft, an interior of an aircraft, and an interior portion of a building.

* * * * *